US006779281B1

(12) United States Patent
Liu

(10) Patent No.: US 6,779,281 B1
(45) Date of Patent: Aug. 24, 2004

(54) SHOE WITH LACE TIGHTENING ASSEMBLY

(76) Inventor: Kun-Chung Liu, No. 5, Alley 9, Lane 212, San-Feng Rd., Hou-Li Hsiang, Taichun Hsien (TW)

( * ) Notice: Subject to any disclaimer, the term of this patent is extended or adjusted under 35 U.S.C. 154(b) by 17 days.

(21) Appl. No.: 10/364,347

(22) Filed: Feb. 12, 2003

(51) Int. Cl.[7] ..... A43C 1/00

(52) U.S. Cl. ..... 36/50.1; 36/136; 24/712.1; 24/712.5; 24/713.6; 24/714.6

(58) Field of Search ..... 36/50.1, 136, 1; 24/712.1, 712, 712.5, 713.2, 714.6, 115 G, 713.6, 714.1

(56) References Cited

U.S. PATENT DOCUMENTS 3,122,805 A * 3/1964 Hakim ..... 24/712.3
6,003,214 A * 12/1999 Lee ..... 24/712.1
6,370,743 B2 * 4/2002 Choe ..... 24/712
6,510,627 B1 * 1/2003 Liu ..... 36/50.1
6,532,688 B2 * 3/2003 Bouvier ..... 36/50.1
6,536,086 B2 * 3/2003 Liu ..... 24/712.1

* cited by examiner

*Primary Examiner*—M. D. Patterson
(74) *Attorney, Agent, or Firm*—Foley & Lardner LLP

(57) ABSTRACT

A lace tightening assembly is applied to a shoe body having eyelet tabs, and includes a mounting seat, a tightening member mounted pivotally in the mounting seat, and a pull cord for operating the tightening member to pivot between a shoe lace tightening position and a shoe lace loosening position.

17 Claims, 7 Drawing Sheets

SHOE WITH LACE TIGHTENING ASSEMBLY

BACKGROUND OF THE INVENTION

1. Field of the Invention

The invention relates to a shoe, more particularly to a shoe with a lace tightening assembly.

2. Description of the Related Art

In co-pending U.S. patent application Ser. No. 09/920,946, the applicant disclosed a double-bow shoe lace device for a shoe. The double-bow shoe lace device includes a shoe lace, a clamp member, and an assembly of two loops and a decorative knot. The shoe lace has a first lace segment that is strung on the shoe so as to form a criss-cross pattern on the eyelet tabs, and a second lace segment that includes first and second lace portions. Each of the lace portions has a lower end connected to the first lace segment so as to be anchored on a respective one of the eyelet tabs. The clamp member is sleeved slidably on at least one of the lace portions. Downward and upward movements of the clamp member along at least one of the lace portions result in tightening and loosening of the shoe. The assembly is disposed on and externally of the clamp member.

SUMMARY OF THE INVENTION

An object of the present invention is to provide a lace tightening assembly for use with a shoe body, which facilitates tightening and loosening of a shoe lace.

Another object of the present invention is to provide a shoe with a lace tightening assembly that facilitates tightening and loosening of a shoe lace, and that is relatively effective for hiding the lace tightening assembly.

The lace tightening assembly for use with a shoe body according to one aspect of this invention is adapted for use with a shoe body that has a front end, a rear end, a shoe opening adjacent to the rear end, a shoe tongue that extends along a reference line from the front end toward the shoe opening, a pair of eyelet tabs disposed on opposite lateral sides of the shoe tongue, and a shoe lace tied to the eyelet tabs and having a pair of distal lace segments. The lace tightening assembly includes a connecting member and two lace tightening units.

The connecting member has two opposite end segments and an intermediate segment between the end segments. The intermediate segment extends along a longitudinal direction transverse to the reference line when the connecting member is disposed on the shoe body.

The lace tightening units are connected to the opposite end segments of the connecting member, respectively. Each of the lace tightening units includes a mounting seat, a pivot axle, a tightening member, and a pull cord.

The mounting seat includes a pair of side walls spaced apart from each other in a direction parallel to the reference line when the mounting seat is disposed on the shoe body. Each of the side walls has proximate and distal edges respectively disposed proximate to and distal from the connecting member. Each of the side walls further has a top edge that interconnects the proximate and distal edges. The mounting seat further includes a top wall that interconnects the top edges of the side walls and that cooperates with the side walls to form a lace receiving space. The top wall has an inner wall surface that confronts the lace receiving space and that has first and second wall ends spaced apart from each other. The top wall further has a hole formed therethrough for access to the lace receiving space.

The pivot axle extends between the side walls, and is disposed between the distal and proximate edges of the side walls and distal from the top wall.

The tightening member is disposed in the lace receiving space, and has a pivot portion mounted pivotally on the pivot axle, a clamping portion extending from the pivot portion, and an actuating portion extending from the pivot portion and distal from the clamping portion. The tightening member cooperates with the inner wall surface of the top wall to confine a lace passage within the lace receiving space. The lace passage has a first passage opening defined by the first wall end and the actuating portion, and a second passage opening defined by the second wall end and the clamping portion.

The pull cord extends through the hole in the top wall and is connected to the actuating portion of the tightening member.

The lace passage in the mounting seat of each of the lace tightening units is adapted to permit passage of a respective one of the distal lace segments of the shoe lace therethrough.

The tightening member of each of the lace tightening units is pivotable inside the lace receiving space between a shoe lace tightening position, in which the actuating portion is urged by the respective one of the distal lace segments of the shoe lace to pivot toward the reference line to cause the clamping portion to move toward the reference line to thereby clamp the respective one of the distal lace segments of the shoe lace at the second passage opening, and a shoe lace loosening position, in which the actuating portion is pulled to pivot away from the reference line upon application of a pulling force on the pull cord to cause the clamping portion to move away from the reference line to thereby release the respective one of the distal lace segments of the shoe lace from being clamped at the second passage opening.

The shoe according to another aspect of this invention includes a shoe body, a lace tightening assembly, and a shoe lace.

The shoe body has a front end, a rear end, a shoe opening adjacent to the rear end, a shoe tongue that extends along a reference line from the front end toward the shoe opening, and a pair of eyelet tabs disposed on opposite lateral sides of the shoe tongue. Each of the eyelet tabs is formed with a plurality of eyelets.

The lace tightening assembly includes a mounting seat, a pivot axle, a tightening member, and a pull cord.

The mounting seat includes a pair of side walls spaced apart from each other in a direction parallel to the reference line when the mounting seat is disposed on the shoe body. Each of the side walls has proximate and distal edges respectively disposed proximate to and distal from the reference line when the mounting seat is disposed on the shoe body. Each of the side walls further has a top edge that interconnects the proximate and distal edges. The mounting seat further includes a top wall that interconnects the top edges of the side walls and that cooperates with the side walls to form a lace receiving space. The top wall has an inner wall surface that confronts the lace receiving space and that has first and second wall ends spaced apart from each other in a direction transverse to the reference line when the mounting seat is disposed on the shoe body. The top wall further has a hole formed therethrough for access to the lace receiving space.

The pivot axle extends between the side walls, and is disposed between the distal and proximate edges of the side walls and distal from the top wall.

The tightening member is disposed in the lace receiving space, and has a pivot portion mounted pivotally on the pivot axle, a clamping portion that extends from the pivot portion, and an actuating portion extending from the pivot portion and distal from the clamping portion. The tightening member cooperates with the inner wall surface of the top wall to confine a lace passage within the lace receiving space. The lace passage has a first passage opening defined by the first wall end and the actuating portion, and a second passage opening defined by the second wall end and the clamping portion.

The pull cord extends through the hole in the top wall and is connected to the actuating portion of the tightening member.

The shoe lace is tied to the eyelet tabs in the eyelets. The shoe lace has a fixing segment fixed on the mounting seat, a positioning segment with an upper end connected to the fixing segment and a lower end anchored on one of the eyelet tabs proximate to the shoe opening, and a distal segment extending from the other one of the eyelet tabs proximate to the shoe opening and through the lace passage in the mounting seat.

The tightening member is pivotable inside the lace receiving space between a shoe lace tightening position, in which the actuating portion is urged by the distal segment of the shoe lace to pivot toward the reference line to cause the clamping portion to move toward the reference line to thereby clamp the distal segment of the shoe lace at the second passage opening, and a shoe lace loosening position, in which the actuating portion is pulled to pivot away from the reference line upon application of a pulling force on the pull cord to cause the clamping portion to move away from the reference line to thereby release the distal segment of the shoe lace from being clamped at the second passage opening.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
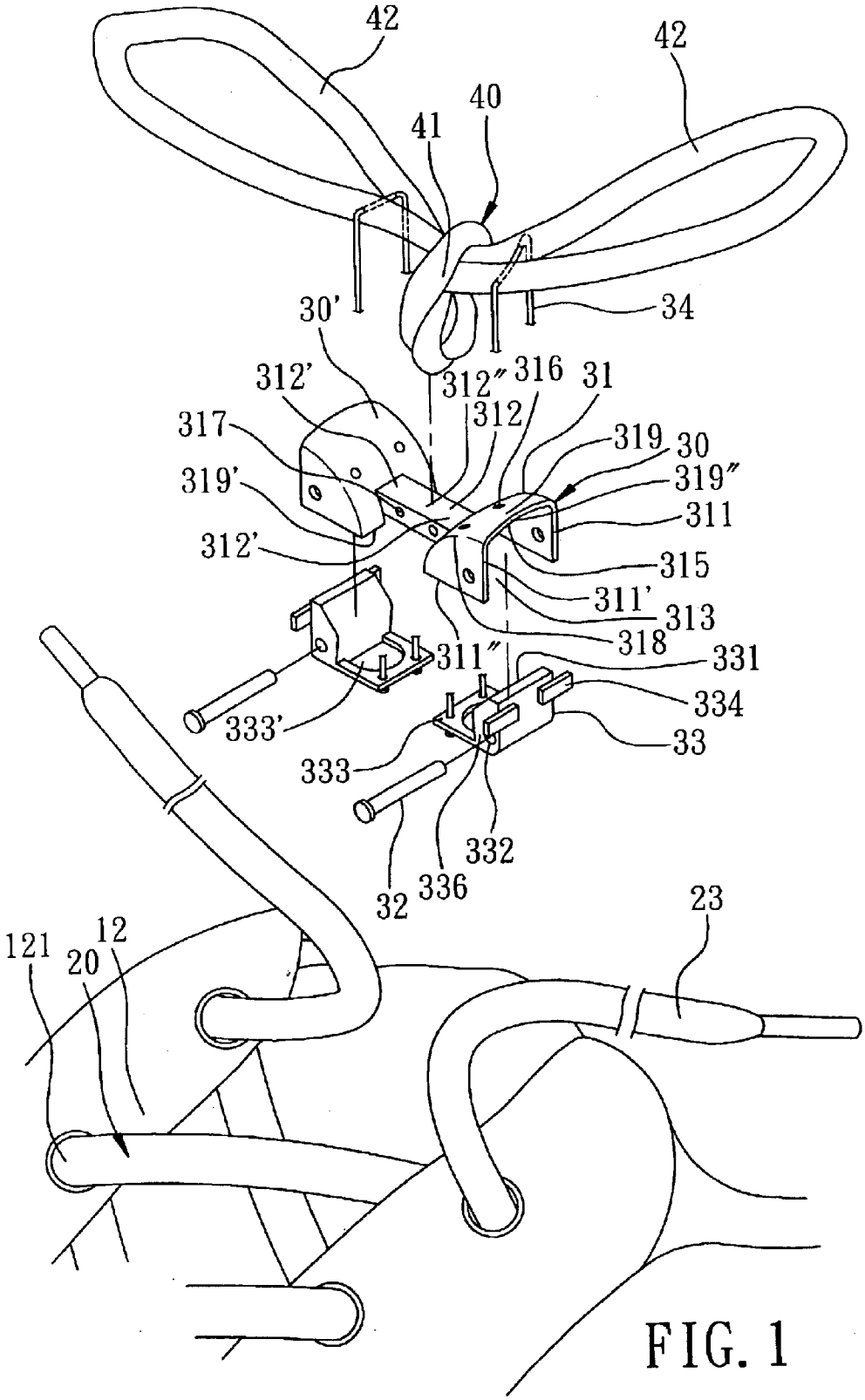
FIG. 1 is an exploded perspective view of the first preferred embodiment of a lace tightening assembly according to this invention used with a shoe body.
Figure 2:
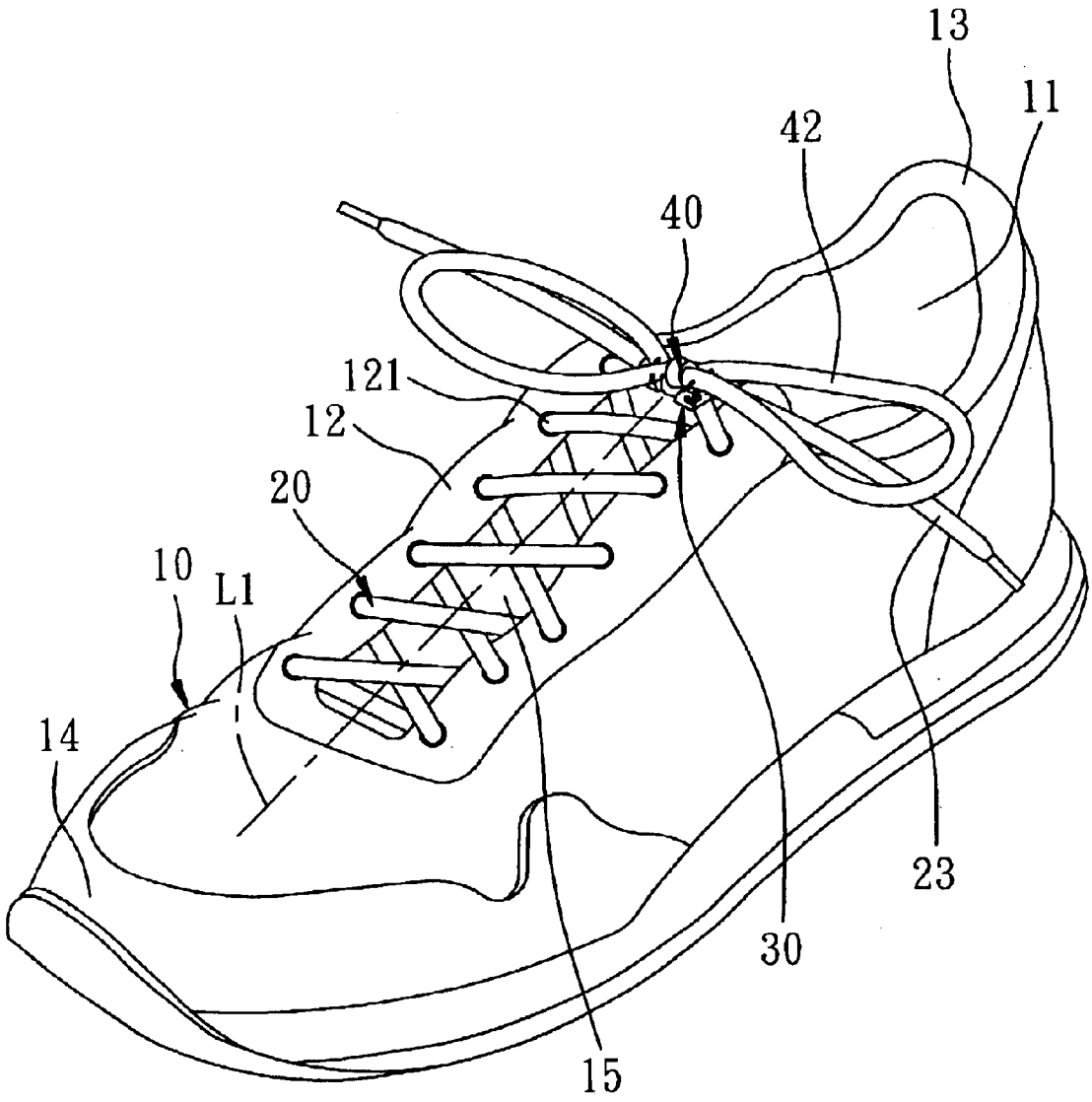
FIG. 2 is a perspective view of the shoe body including the first preferred embodiment.
Figure 3:
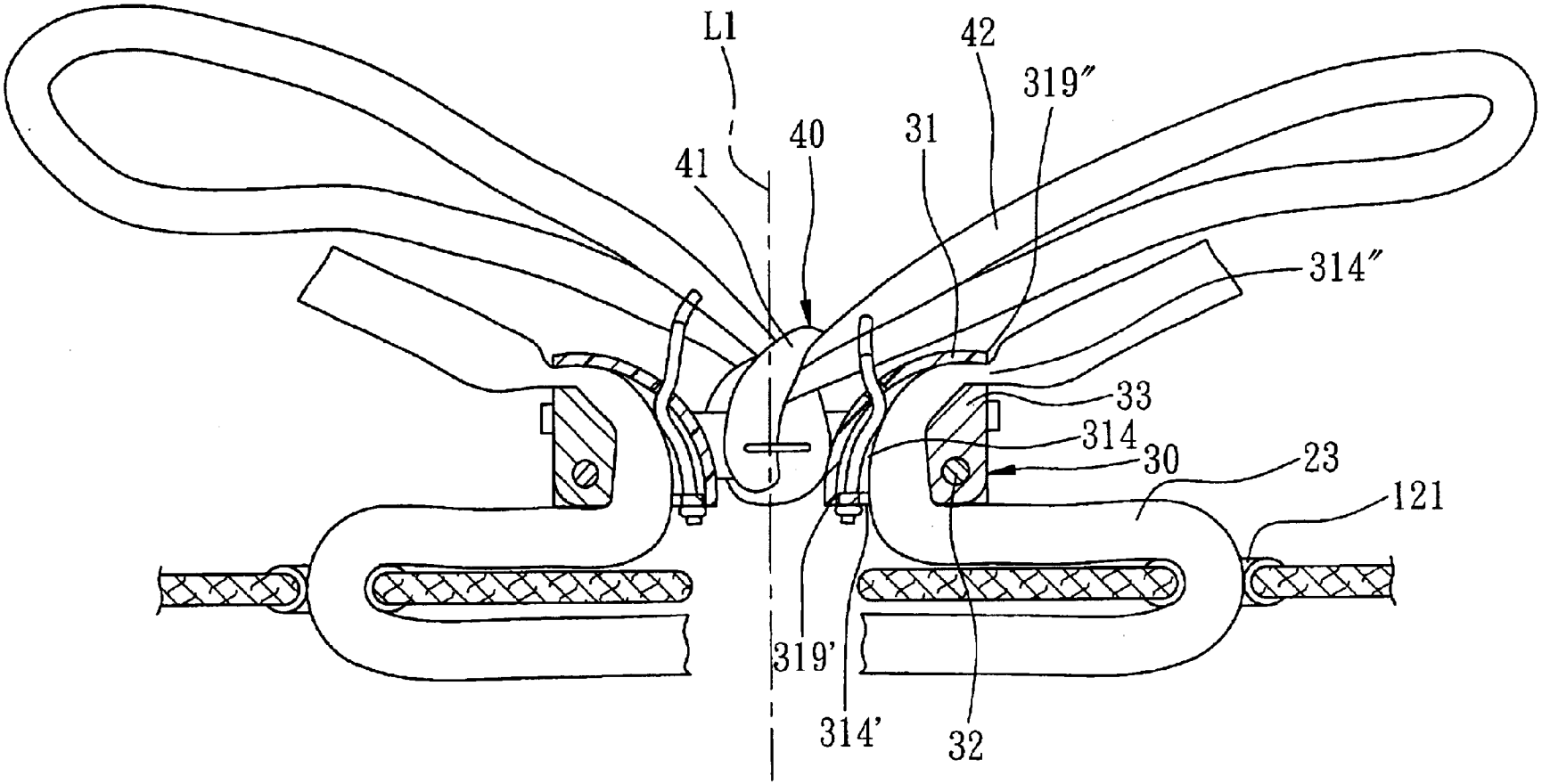
FIG. 3 is a schematic view of the first preferred embodiment.

Referring to FIGS. 1, 2 and 3, the first preferred embodiment of a lace tightening assembly 30 according to this invention is shown to be applied to a shoe body 10 that has a front end 14, a rear end 13, a shoe opening 11 adjacent to the rear end 13, a shoe tongue 15 that extends along a reference line (L1) from the front end 14 toward the shoe opening 11, a pair of eyelet tabs 12 disposed on opposite lateral sides of the shoe tongue 15, and a shoe lace 20 tied to the eyelet tabs 12 and having a pair of distal lace segments 23. Each of the eyelet tabs 12 is formed with a plurality of eyelets 121. The shoe lace 20 further has a shoe lace portion tied to the eyelet tabs 12 by stringing through the eyelets 121 of the eyelet tabs 12 to form a criss-cross pattern on the eyelet tabs 12.

The lace tightening assembly 30 includes a connecting member 312 and two lace tightening units 30'.

The connecting member 312 has two opposite end segments 312' and an intermediate segment 312" between the end segments 312'. The intermediate segment 312" extends along a longitudinal direction transverse to the reference line (L1) when the connecting member 312 is disposed on the shoe body 10. The intermediate segment 312" of the connecting member 312 is formed with a plurality of fixing holes 317.

The lace tightening units 30' are connected to the opposite end segments 312' of the connecting member 312, respectively. Each of the lace tightening units 30' includes a mounting seat 31, a pivot axle 32, a tightening member 33, and a pull cord 34.

The mounting seat 31 includes a pair of side walls 311 spaced apart from each other in a direction parallel to the reference line (L1) when the mounting seat 31 is disposed on the shoe body 10. Each of the side walls 311 has proximate and distal edges 311", 311' respectively disposed proximate to and distal from the connecting member 312. Each of the side walls 311 further has a top edge 318 that interconnects the proximate and distal edges 311", 311'. The mounting seat 31 further includes a top wall 319 that interconnects the top edges 318 of the side walls 311 and that cooperates with the side walls 311 to form a lace receiving space 313. The top wall 319 has an inner wall surface 315 that confronts the lace receiving space 313 and that has first and second wall ends 319', 319" spaced apart from each other. The top wall 319 further has a hole 316 formed therethrough for access to the lace receiving space 313.

The pivot axle 32 extends between the side walls 311, and is disposed between the distal and proximate edges 311', 311" of the side walls 311 and distal from the top wall 319.

The tightening member 33 is disposed in the lace receiving space 313, and has a pivot portion 332 mounted pivotally on the pivot axle 32, a clamping portion 331 extending from the pivot portion 332, and an actuating portion 336 extending from the pivot portion 332 and distal from the clamping portion 331. The tightening member 33 cooperates with the inner wall surface 315 of the top wall 319 to confine a lace passage within the lace receiving space 314. The lace passage 314 has a first passage opening 314' defined by the first wall end 319' and the actuating portion 336, and a second passage opening 314" defined by the second wall end 319" and the clamping portion 331. The actuating portion 336 is provided with a limit member 333 that extends toward the inner wall surface 315 of the top wall 319, the purpose of which will be described in the succeeding paragraphs.

The pull cord 34 extends through the hole 316 in the top wall 319, and is connected to the actuating portion 336 of the tightening member 33 at the limit member 333. The limit member 333 is formed with a hole 333' that permits passage of the respective one of the distal lace segments 23 of the shoe lace 20 therethrough.

The lace passage 314 in the mounting seat 31 of each of the lace tightening units 30' permits passage of a respective one of the distal lace segments 23 of the shoe lace 20 therethrough.

The lace tightening assembly 30 further includes a decorative member 40 having a fixing portion 41 fixed on the fixing holes 317 of the connecting member 312 and two operating portions 42 extending from the fixing portion 41 and connected to the pull cords 34 of the lace tightening units 30', respectively. The fixing portion 41 is a knot, and the operating portions 42 are loops connected to the knot so as to cooperate with the distal lace segments 23 of the shoe lace to form a double-bow configuration to hide the lace tightening assembly 30 thereunder.

Figure 4:
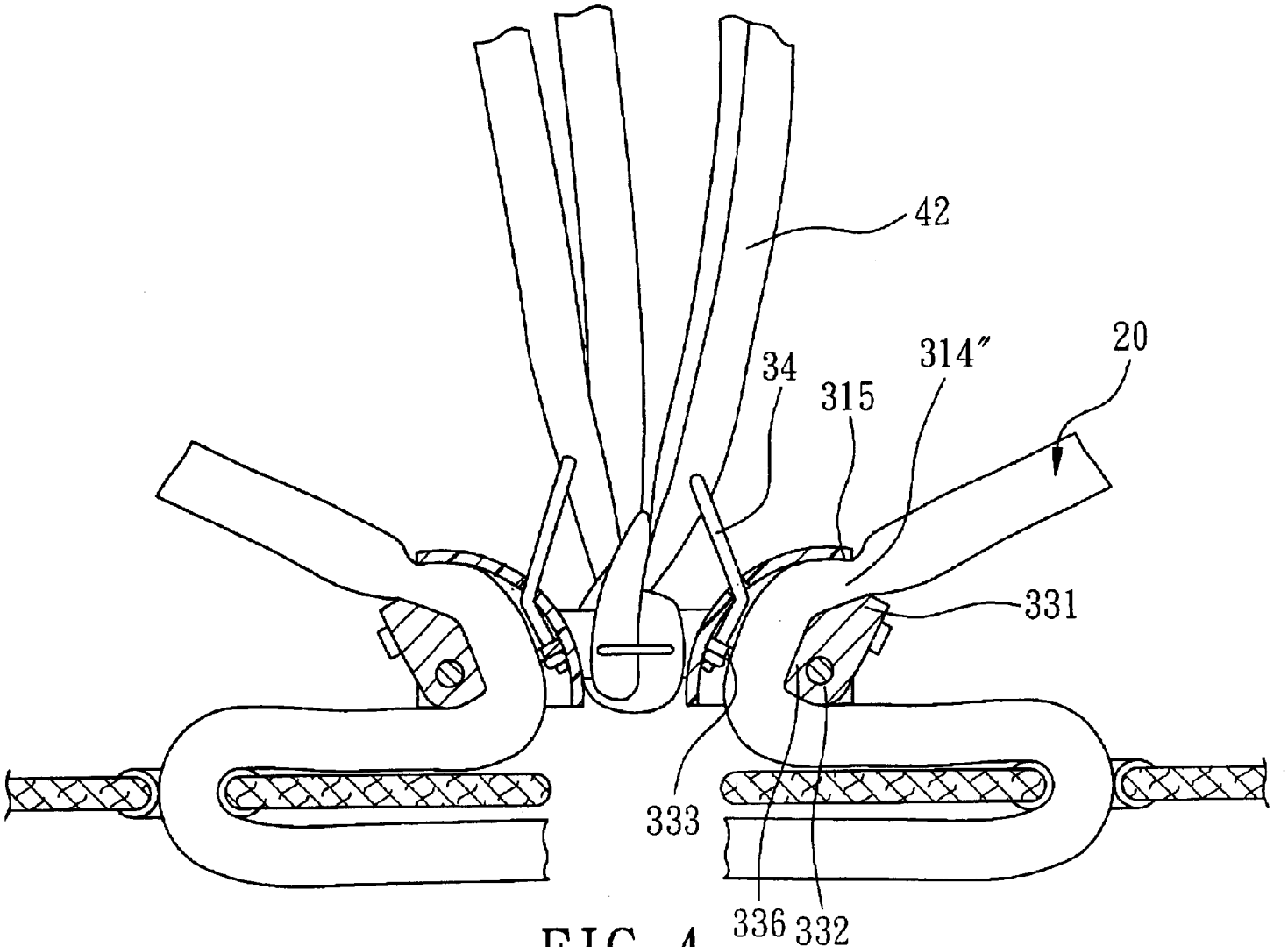
FIG. 4 is a schematic view of the first preferred embodiment in a lace loosening state.
Figure 5:
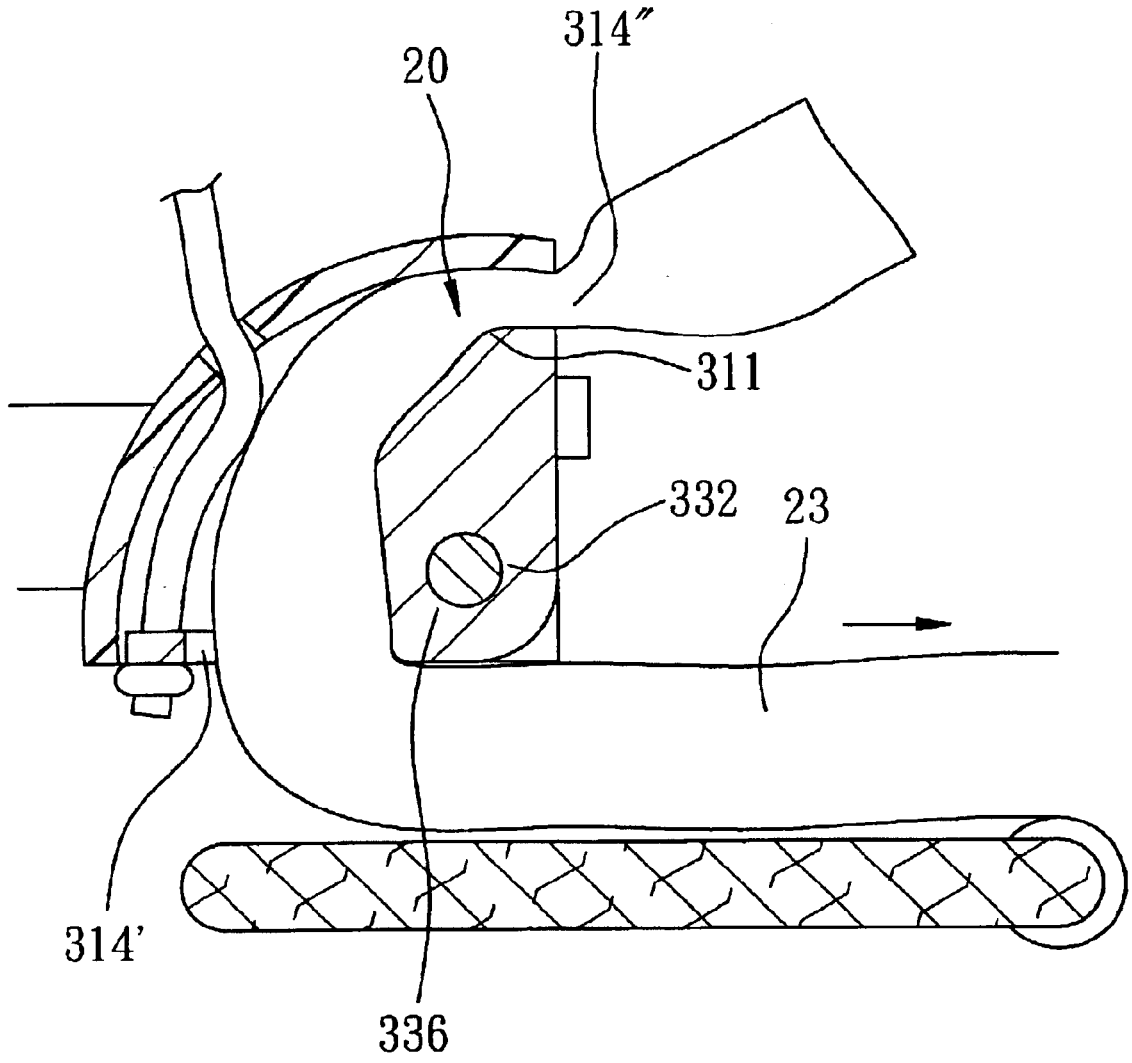
FIG. 5 is a schematic view of the first preferred embodiment in a lace tightening state.

The tightening member 33 of each of the lace tightening units 30' is pivotable inside the lace receiving space 313 between a shoe lace tightening position illustrated in FIG. 5, in which the actuating portion 336 is urged by the respective one of the distal lace segments 23 of the shoe lace 20 to pivot toward the reference line (L1) to cause the clamping portion 331 to move toward the reference line (L1) to thereby clamp the respective one of the distal lace segments 23 of the shoe lace 20 at the second passage opening 314", and a shoe lace loosening position illustrated in FIG. 4, in which the actuating portion 336 at the limit member 333 is pulled to pivot away from the reference line (L1) upon application of a pulling force on the pull cord 34 by pulling upward the corresponding one of the operating portions 42 of the decorative member 40 to cause the clamping portion 331 to move away from the reference line (L1) to thereby release the respective one of the distal lace segments 23 of the shoe lace 20 from being clamped at the second passage opening 314". The limit member 333 of the pivot portion 332 extends toward the inner wall surface 315 of the top wall 319 to limit extent of pivoting movement of the tightening member 33 from the shoe lace tightening position to the shoe lace loosening position. Furthermore, the clamping portion 331 is formed with a pair of stop units 334 for engaging the side walls 311 to limit extent of pivoting movement of the tightening member 33 from the shoe lace loosening position to the shoe lace tightening position.

Figure 6:
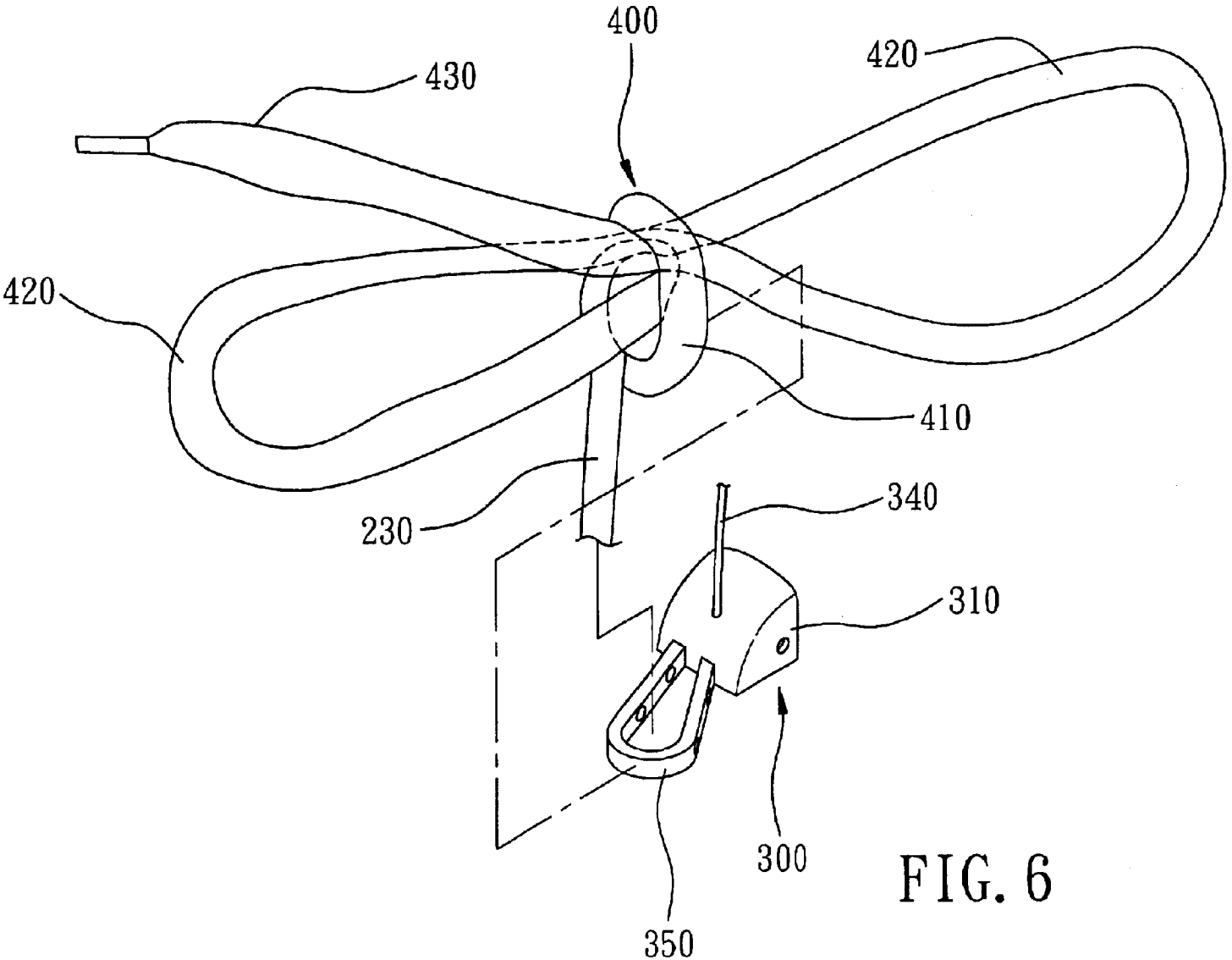
FIG. 6 is a fragmentary perspective view of the second preferred embodiment of a lace tightening assembly according to this invention.
Figure 7:
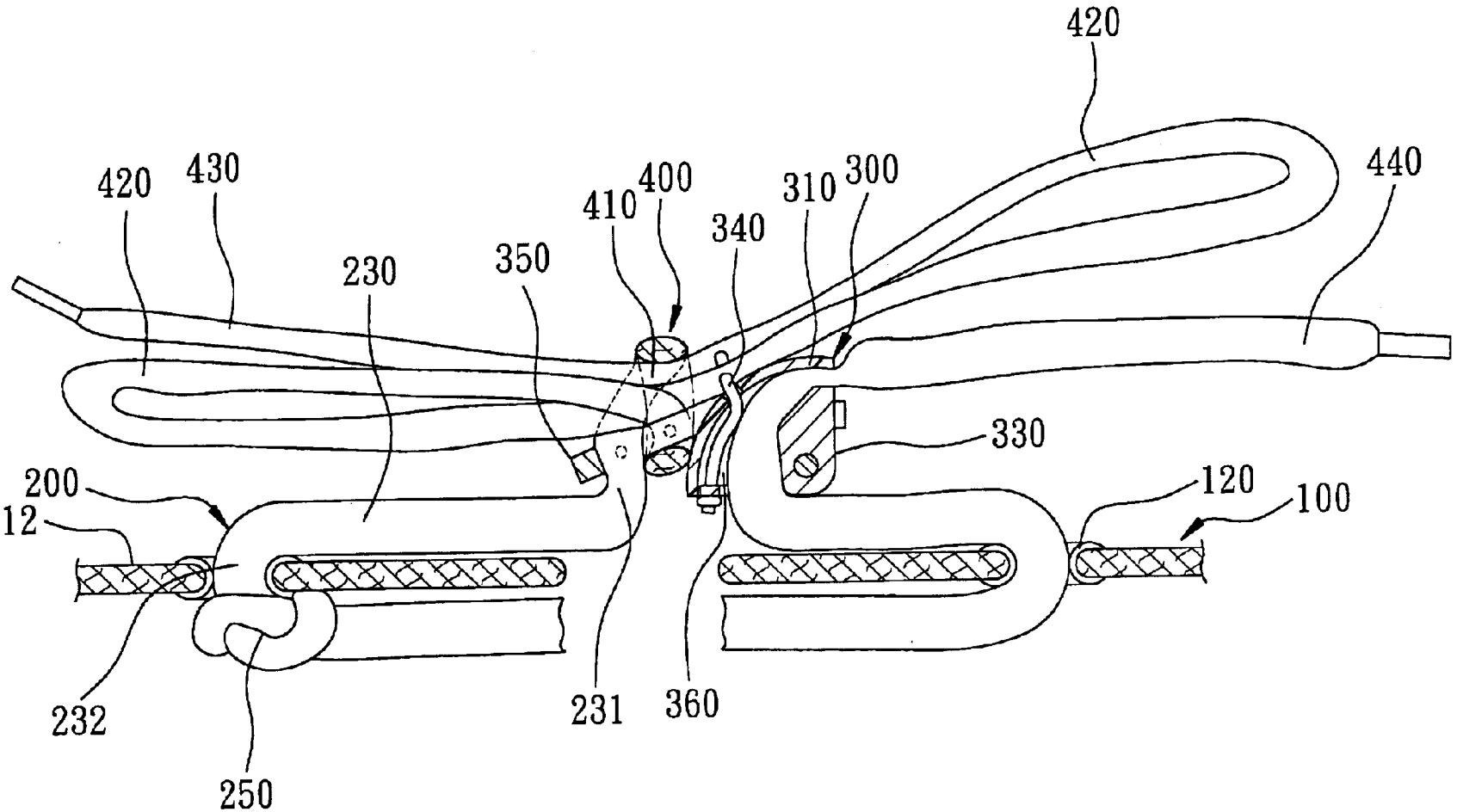
FIG. 7 is a fragmentary schematic view showing a shoe body incorporating the second embodiment.

Referring to FIGS. 6 and 7, the second embodiment of a lace tightening assembly 300 is applied to a shoe body 100 including a shoe lace 200 tied to the eyelet tabs 120 in the eyelets12. The shoe lace 200 has a fixing segment 400 fixed on the mounting seat 310 of the lace tightening assembly 300, a positioning segment 230 with an upper end 231 connected to the fixing segment 410 and a lower end 232 anchored on one of the eyelet tabs 12 proximate to the shoe opening (not shown), and a distal segment 440 extending from the other one of the eyelet tabs 12 proximate to the shoe opening and through the lace passage 360 in the mounting seat 310. The lower end 232 of the positioning segment 23 of the shoe lace 200 is formed with a positioning knot 250 under the one of the eyelet tabs 12 so that the positioning segment 230 of the shoe lace 200 has a constant length. Preferably, the mounting seat 310 is formed with an anchoring loop 350 for mounting the fixing segment 400 of the shoe lace 200 thereon. The fixing segment 400 of the shoe lace 200 includes a knot 410 connected to the upper end 231 of the positioning segment 230 and fixed to the anchoring loop 350. The fixing segment 400 of the shoe lace 200 further includes first and second loop sections 420 connected to the knot 410, and a distal lace section 430 connected to one of the first and second loop sections 420. Therefore, the fixing segment 400 cooperates with the distal segment 440 to form a double-bow configuration on the lace tightening assembly 300. The pull cord 340 is connected between one of the first and second loop sections 420 and the tightening member 330 so as to operate the shoe lace 200 between the lace tightening position and the lace loosening position.

In view of the aforesaid, the lace tightening assembly of this invention facilitates tightening and loosening of a shoe lace, and is relatively effective for hiding the lace tightening assembly.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A lace tightening assembly adapted for use with a shoe body that has a front end, a rear end, a shoe opening adjacent to the rear end, a shoe tongue that extends along a reference line from the front end toward the shoe opening, a pair of eyelet tabs disposed on opposite lateral sides of the shoe tongue, and a shoe lace tied to the eyelet tabs and having a pair of distal lace segments, said lace tightening assembly comprising:

a connecting member having two opposite end segments and an intermediate segment between said end segments, said intermediate segment extending along a longitudinal direction transverse to the reference line when said connecting member is disposed on the shoe body; and two lace tightening units connected to said opposite end segments of said connecting member, respectively, each of said lace tightening units including a mounting seat including a pair of side walls spaced apart from each other in a direction parallel to the reference line when said mounting seat is disposed on the shoe body, each of said side walls having proximate and distal edges respectively disposed proximate to and distal from said connecting member, each of said side walls further having a top edge that interconnects said proximate and distal edges, said mounting seat further including a top wall that interconnects said top edges of said side walls and that cooperates with said side walls to form a lace receiving space, said top wall having an inner wall surface that confronts said lace receiving space and that has first and second wall ends spaced apart from each other, said top wall further having a hole formed therethrough for access to said lace receiving space, a pivot axle extending between said side walls, and disposed between said distal and proximate edges of said side walls and distal from said top wall, a tightening member disposed in said lace receiving space and having a pivot portion mounted pivotally on said pivot axle, a clamping portion extending from said pivot portion, and an actuating portion extending from said pivot portion and distal from said clamping portion, said tightening member cooperating with said inner wall surface of said top wall to confine a lace passage within said lace receiving space, said lace passage having a first passage opening defined by said first wall end and said actuating portion, and a second passage opening defined by said second wall end and said clamping portion, and a pull cord extending through said hole in said top wall and connected to said actuating portion of said tightening member;

said lace passage in said mounting seat of each of said lace tightening units being adapted to permit passage of a respective one of the distal lace segments of the shoe lace therethrough;

said tightening member of each of said lace tightening units being pivotable inside said lace receiving space between a shoe lace tightening position, in which said actuating portion is urged by the respective one of the distal lace segments of the shoe lace to pivot toward said reference line to cause said clamping portion to move toward said reference line to thereby clamp the respective one of the distal lace segments of the shoe lace at said second passage opening, and a shoe lace loosening position, in which said actuating portion is pulled to pivot away from said reference line upon application of a pulling force on said pull cord to cause said clamping portion to move away from said reference line to thereby release the respective one of the distal lace segments of the shoe lace from being clamped at said second passage opening.

2. The lace tightening assembly as claimed in claim 1, further comprising a decorative member having a fixing portion fixed on said connecting member and two operating portions extending from said fixing portion and connected to said pull cords of said lace tightening units, respectively.

3. The lace tightening assembly as claimed in claim 2, wherein said fixing portion is a knot, and said operating portions are loops connected to said knot.

4. The lace tightening assembly as claimed in claim 1, wherein said clamping portion is formed with a stop unit for engaging one of said side walls to limit extent of pivoting movement of said tightening member from said shoe lace loosening position to said shoe lace tightening position.

5. The lace tightening assembly as claimed in claim 1, wherein said actuating portion is provided with a limit member that extends toward said inner wall surface of said top wall to limit extent of pivoting movement of said tightening member from said shoe lace tightening position to said shoe lace loosening position.

6. The lace tightening assembly as claimed in claim 5, wherein said pull cord is tied to said actuating portion at said limit member.

7. The lace tightening assembly as claimed in claim 5, wherein said limit member is formed with a hole that permits passage of the respective one of the distal lace segments of the shoe lace therethrough.

8. A shoe, comprising:

a shoe body that has a front end, a rear end, a shoe opening adjacent to said rear end, a shoe tongue that extends along a reference line from said front end toward said shoe opening, and a pair of eyelet tabs disposed on opposite lateral sides of said shoe tongue, each of said eyelet tabs being formed with a plurality of eyelets;

a lace tightening assembly including a mounting seat including a pair of side walls spaced apart from each other in a direction parallel to said reference line when said mounting seat is disposed on said shoe body, each of said side walls having proximate and distal edges respectively disposed proximate to and distal from said reference line when said mounting seat is disposed on said shoe body, each of said side walls further having a top edge that interconnects said proximate and distal edges, said mounting seat further including a top wall that interconnects said top edges of said side walls and that cooperates with said side walls to form a lace receiving space, said top wall having an inner wall surface that confronts said lace receiving space and that has first and second wall ends spaced apart from each other in a direction transverse to said reference line when said mounting seat is disposed on said shoe body, said top wall further having a hole formed therethrough for access to said lace receiving space, a pivot axle extending between said side walls, and disposed between said distal and proximate edges of said side walls and distal from said top wall, a tightening member disposed in said lace receiving space and having a pivot portion mounted pivotally on said pivot axle, a clamping portion that extends from said pivot portion, and an actuating portion extending from said pivot portion and distal from said clamping portion, said tightening member cooperating with said inner wall surface of said top wall to confine a lace passage within said lace receiving space, said lace passage having a first passage opening defined by said first wall end and said actuating portion, and a second passage opening defined by said second wall end and said clamping portion, and a pull cord extending through said hole in said top wall and connected to said actuating portion of said tightening member; and a shoe lace tied to said eyelet tabs in said eyelets, said shoe lace having a fixing segment fixed on said mounting seat, a positioning segment with an upper end connected to said fixing segment and a lower end anchored on one of said eyelet tabs proximate to said shoe opening, and a distal segment extending from the other one of said eyelet tabs proximate to said shoe opening and through said lace passage in said mounting seat;

said tightening member being pivotable inside said lace receiving space between a shoe lace tightening position, in which said actuating portion is urged by said distal segment of said shoe lace to pivot toward said reference line to cause said clamping portion to move toward said reference line to thereby clamp said distal segment of said shoe lace at said second passage opening, and a shoe lace loosening position, in which said actuating portion is pulled to pivot away from said reference line upon application of a pulling force on said pull cord to cause said clamping portion to move away from said reference line to thereby release said distal segment of said shoe lace from being clamped at said second passage opening.

9. The shoe as claimed in claim 8, wherein said lower end of said positioning segment of said shoe lace is formed with a positioning knot under said one of said eyelet tabs so that said positioning segment of said shoe lace has a constant length.

10. The shoe as claimed in claim 8, wherein said mounting seat is formed with an anchoring loop for mounting said fixing segment of said shoe lace thereon.

11. The shoe as claimed in claim 10, wherein said fixing segment of said shoe lace includes a knot connected to said upper end of said positioning segment and fixed to said anchoring loop.

12. The shoe as claimed in claim 11, wherein said fixing segment of said shoe lace further includes first and second loop sections connected to said knot, and a distal lace section connected to one of said first and second loop sections.

13. The shoe as claimed in claim 12, wherein said pull cord is connected to one of said first and second loop sections.

14. The shoe as claimed in claim 8, wherein said clamping portion of said tightening member is formed with a stop unit for engaging one of said side walls to limit extent of pivoting movement of said tightening member from said shoe lace loosening position to said shoe lace tightening position.

15. The shoe as claimed in claim 8, wherein said actuating portion of said tightening member is provided with a limit member that extends toward said inner wall surface of said top wall to limit extent of pivoting movement of said tightening member from said shoe lace tightening position to said shoe lace loosening position.

16. The shoe as claimed in claim 15, wherein said pull cord is tied to said actuating portion at said limit member.

17. The shoe as claimed in claim 15, wherein said limit member is formed with a hole that permits passage of said distal segment of said shoe lace therethrough.

* * * * *